US005284742A

United States Patent [19]

Yamazaki et al.

[11] Patent Number: 5,284,742

[45] Date of Patent: Feb. 8, 1994

[54] SILVER HALIDE PHOTOGRAPHIC LIGHT-SENSITIVE MATERIAL

[75] Inventors: Katsumasa Yamazaki; Shigeto Hirabayashi, both of Hachioji, Japan

[73] Assignee: Konica Corporation, Tokyo, Japan

[21] Appl. No.: 901,126

[22] Filed: Jun. 19, 1992

[30] Foreign Application Priority Data

Jun. 28, 1991 [JP] Japan ..... 3-185113

[51] Int. Cl.[5] ..... G03C 1/34; G03C 7/36

[52] U.S. Cl. ..... 430/551; 430/556; 430/557

[58] Field of Search ..... 430/551, 556, 557

[56] References Cited

U.S. PATENT DOCUMENTS

| | | | |
|---|---|---|---|
| 4,254,216 | 3/1981 | Uchida et al. | 430/551 |
| 4,992,360 | 2/1991 | Tsuruta et al. | 430/557 |
| 5,021,333 | 6/1991 | Leyshon et al. | 430/557 |
| 5,183.731 | 2/1993 | Takahashi et al. | 430/557 |

FOREIGN PATENT DOCUMENTS

| | | | |
|---|---|---|---|
| 0298321 | 1/1989 | European Pat. Off. . | |
| 1241553 | 9/1989 | Japan | 430/551 |

*Primary Examiner*—Lee C. Wright
*Attorney, Agent, or Firm*—Finnegan, Henderson Farabow, Garrett & Dunner

[57] ABSTRACT

A silver halide color photographic light-sensitive material is disclosed, which gives a color image excellent in the light-fastness and color reproducibility. The light-sensitive material comprises a support and a silver halide emulsion layer, and the emulsion layer contains a yellow dye-forming coupler represented by Formula Y-I and a compound represented by Formula I:

(Y-I)

wherein $R^1$ is an alkyl group or a cycloalkyl group; $R^2$ is an alkyl group, cycloalkyl group, an acyl group or an aryl group; $R^3$ is a substituent; n is 0 or 1; $X^1$ is a substituent capable of splitting off upon coupling reaction with the oxidation product of a color developing agent; and $Y^1$ is an organic group, (I)

wherein $R_A$ and $R_B$ are independently an alkyl group, a cycloalkyl group or an alkenyl group; and $R_C$ and $R_D$ are independently a hydrogen atom, an alkyl group, a cycloalkyl group or an alkenyl group.

10 Claims, No Drawings

SILVER HALIDE PHOTOGRAPHIC LIGHT-SENSITIVE MATERIAL

FIELD OF THE INVENTION

The present invention relates to a silver halide photographic light-sensitive material, more specifically to a silver halide photographic light-sensitive material improved in color reproducibility and color developability and capable of providing a dye image which is fast to light.

BACKGROUND OF THE INVENTION

In silver halide photographic light-sensitive materials for direct appreciation such as color paper, a yellow coupler, a magenta coupler and a cyan coupler are usually employed in combination for forming a dye image. These couplers are required to bring out well colors which are fadeproof and very much alike to those of a subject. In recent years, demand for a light-sensitive material improved in color reproducibility, i.e., capable of forming an image accurately reproducing the colors of a subject, has been on the increase.

Color reproducibility is greatly affected by the absorption characteristics of a dye formed by a coupler, and, therefore, a great deal of efforts have been made to develop a coupler with suitable absorption characteristics. A pivaloylacetoanilide-type yellow coupler having an alkoxy group in its anilide portion, disclosed in Japanese Patent Publication Open to Public Inspection (hereinafter referred to as "Japanese Patent O.P.I. Publication") Nos. 123047/1988, 245949/1990 and 96774/1990, is able to provide a dye which has a sharp absorption peak, and hence, can be advantageously employed in color paper.

However, the above-mentioned yellow coupler has been found to have poor fastness to light.

SUMMARY OF THE INVENTION

The object of the present invention is to provide a silver halide photographic light-sensitive material improved in color reproducibility and color developability, and capable of forming a dye image which is fast to light.

The above object can be attained by a silver halide photographic light-sensitive material comprising a support having thereon a silver halide emulsion layer, containing at least one yellow coupler represented by formula Y-1 and a compound represented by formula I:

Formula Y-1

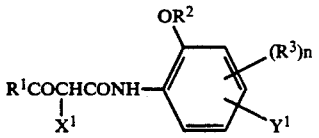

wherein $R^1$ represents an alkyl group or a cycloalkyl group; $R^2$ represents an alkyl group, a cycloalkyl group, an acyl group or an aryl group; $R^3$ represents a group capable of being substituted on a benzene ring; n represents 0 or 1; $X^1$ represents a group capable of being released upon a coupling reaction with the oxidation product of a developing agent; and $Y^1$ represents an organic group.

Formula I

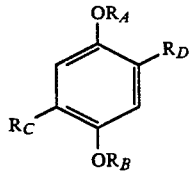

wherein $R_A$ and $R_B$ each represent an alkyl group, a cycloalkyl group or an alkenyl group; and $R_C$ and $R_D$ each represent a hydrogen atom, an alkyl group, a cycloalkyl group or an alkenyl group.

DETAILED DESCRIPTION OF THE INVENTION

An explanation will be given on a yellow coupler represented by formula Y-I.

Examples of the alkyl group represented by $R^1$ include methyl, ethyl, isopropyl, t-butyl and dodecyl. The alkyl group may have a substituent such as a halogen atom, an aryl group, an alkoxy group, an aryloxy group, an alkylsulfonyl group, an acylamino group and a hydroxyl group.

The cycloalkyl group represented by $R^1$ may be cyclopropyl, cyclohexyl or adamantyl.

A branched alkyl group, in particular, t-butyl, is preferable as $R^1$.

In Formula Y-1, the alkyl group and the cycloalkyl group represented by $R^2$ may be the same as the alkyl group and the cycloalkyl group represented by $R^1$. The aryl group represented by $R^2$ may be phenyl. The alkyl group, the cycloalkyl group and the aryl group represented by $R^2$ each may have the same substituent as that for $R^1$. Examples of the acyl group represented by $R^2$ include acetyl, propionyl, butylyl, hexanoyl and benzoyl.

$R^2$ may preferably be an alkyl group or an aryl group, still preferably an alkyl group, most preferably a lower alkyl group with 5 or less carbon atoms.

In formula Y-I, the group represented by $R^3$ capable of being substituted on a benzene ring may be a halogen atom, e.g. a chlorine atom, an alkyl group, e.g. ethyl, i-propyl, t-butyl, an alkoxy group, e.g. methoxy, an aryloxy group, e.g. phenyloxy, an acyloxy group, e.g. methylcarbonyloxy, benzoyloxy, an acylamino group, e.g. acetoamide, phenylcarbonylamino, a carbamoyl group, e.g. N-methylcarbamoyl, N-phenylcarbamoyl, an alkylsulfonamido group, e.g. ethylsulfonamido, an arylsulfonamido group, e.g. phenylsulfonamido, a sulfamoyl group, e.g. N-propylsulfamoyl, N-phenylsulfamoyl and an imido group, e.g. succinimido, glutarimido. n represents 0 or 1.

In formula Y-I, $Y^1$ represents an organic group, which may preferably be a group represented by the following formula Y-II.

Formula Y-II $$-J-R^4$$

wherein J represents $-N(R^5)-CO-$, $-CON(R^5)-$, $-COO-$, $-N(R^5)-SO_2-$, or $-SO_2-N(R^5)-$; and $R^4$ and $R^5$ each represent a hydrogen atom, an alkyl group, an aryl group or a heterocyclic group.

Examples of the alkyl group represented by $R^4$ or $R^5$ include methyl, ethyl, isopropyl, t-butyl and dodecyl. The aryl group represented by $R^4$ or $R^5$ may preferably be phenyl or naphthyl. The alkyl group and the aryl group each may have a substituent. Examples of suitable substituents include a halogen atom, e.g. a chlorine atom, an alkyl group, e.g. ethyl, t-butyl, an aryl group, e.g. phenyl, p-methoxyphenyl, naphthyl, an alkoxy group, e.g. ethoxy, benzyloxy, an aryloxy group, e.g. phenoxy, an alkylthio group, e.g. ethylthio, an arylthio group, e.g. phenylthio, an alkylsulfonyl group, e.g. β-hydroxyethylsulfonyl and an arylsulfonyl group, e.g. phenylsulfonyl. Also usable are an acylamino group such as an alkylcarbonylamino group, e.g. acetoamide, and an arylcarbonylamino group, e.g. phenylcarbonylamino; a carbamoyl group including one substituted with an alkyl group or an aryl group preferably phenyl, such as N-methylcarbamoyl and N-phenylcarbamoyl; an acyl group, including an alkylcarbonyl group such as an acetyl group and an arylcarbonyl group such as a benzoyl group; a sulfonamide group including an alkylsulfonamide group such as methylsulfonylamide and an arylsulfonamide group such as benzenesulfonylamide; a sulfamoyl group, including one substituted with an alkyl group or an aryl group preferably phenyl, such as N-methylsulfamoyl and N-phenylsulfamoyl; a hydroxy group; and a nitrilo group.

As the group represented by $—J—R_4$, $—NHCOR'_4$ is especially preferable. Here, $R'_4$ represents an organic group, which is preferably a straight chain or branched alkyl with 1 to 30 carbon atoms, examples of which including methyl, ethyl, n-propyl, isopropyl, t-butyl, n-pentyl, n-hexyl, 2-ethylhexyl, n-octyl, n-decyl, straight chain or branched dodecyl, tridecyl, tetradecyl, pentadecyl, hexadecyl, heptadecyl, octadecyl, nonadecyl, eicosyl, docosyl, tetracosyl and hexacosyl. Of these alkyl groups, those with 8 to 20 carbon atoms are especially preferable.

In formula Y-I, $X^1$ represents a group capable of being released upon a coupling reaction with an oxidation product of developing agent. The group may be one represented by formula Y-III or formula Y-IV. A group represented by formula Y-IV is especially preferable.

Formula Y-III $$—OR^6$$

wherein $R^6$ represents an aryl group that may have a substituent or a heterocyclic group.

Formula Y-IV

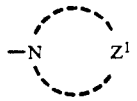

wherein $Z^1$ represents a group of non-metallic atoms necessary for forming a 5- or 6-membered ring together with the nitrogen atom. Examples of elements the group of non-metallic atoms include methylene, methine, substituted methine, $>C=O$, $>NR^6$ ($R^6$ has the same meaning as $R^5$.), $—N=$, $—O—$, $—S—$ and $—SO_2—$.

The yellow coupler represented by formula Y-I may form a bis form at a portion $R^1$, $R^3$ or $Y^1$.

Specific examples of yellow couplers represented by formula Y-I will be given below:

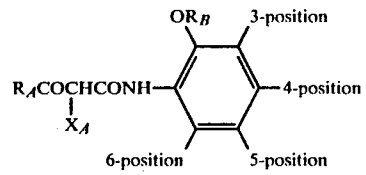
| No. | $R_A$ | $R_B$ | $X_A$ | 3-position | 4-position | 5-position | 6-position |
|---|---|---|---|---|---|---|---|
| Y-1 | (t)$C_4H_9$— | —$CH_3$ | 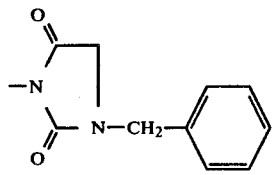 | —H | —H | —NHCO$(CH_2)_3$O— 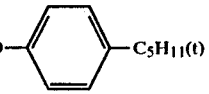 —$C_5H_{11}$(t) | —H |
| Y-2 | (t)$C_4H_9$— | —$CH_3$ | 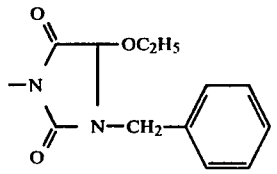 | —H | —H | $C_5H_{11}$(t) —NHCO$CH_2$O— 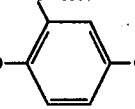 —$C_5H_{11}$(t) | —H |
| Y-3 | (t)$C_4H_9$— | —$CH_3$ | 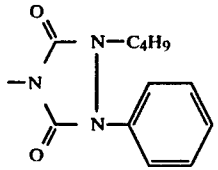 | —H | —H | $CH_3$ \| —NHCO$CH_2$ $CH_2SO_2C_{12}H_{25}$ | —H |
| Y-4 | (t)$C_4H_9$— | —$CH_3$ | 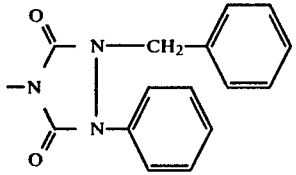 | —H | —H | $C_5H_{11}$(t) —NHCO$(CH_2)_2$COO— 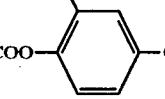 —$C_5H_{11}$(t) | —H |

-continued
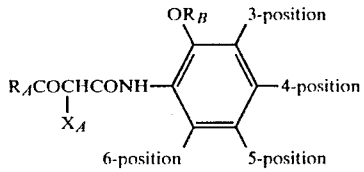
| No. | $R_A$ | $R_B$ | $X_A$ | 3-position | 4-position | 5-position | 6-position |
|---|---|---|---|---|---|---|---|
| Y-5 | (t)$C_4H_9$— | —$CH_3$ | 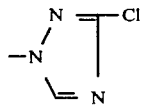 | —H | —H | —N(CH$_2$)—COCH(CH$_3$)CH$_2$SO$_2$C$_{18}$H$_{37}$ 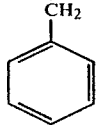 | —H |
| Y-6 | (t)$C_4H_9$— | —$CH_3$ | 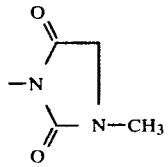 | —H | —H | —NHCOCH(CH$_3$)CH$_2$SO$_2$C$_{12}$H$_{25}$ | —H |
| Y-7 | (t)$C_4H_9$— | —$CH_3$ | 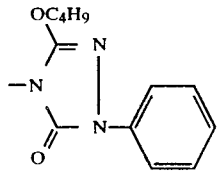 | —H | —H | —NHCO(CH$_2$)$_2$CON(C$_2$H$_5$)C$_{12}$H$_{25}$ | —H |
| Y-8 | (t)$C_4H_9$— | —$C_3H_7$(iso) | 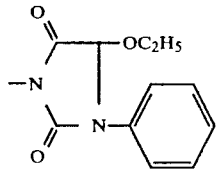 | —H | —H | —CONH(CH$_2$)$_3$CONH— 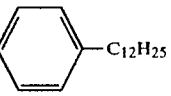 —C$_{12}$H$_{25}$ | —H |

-continued
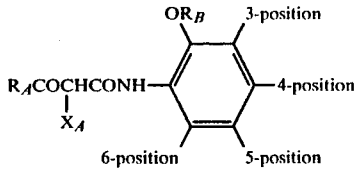
| No. | $R_A$ | $R_B$ | $X_A$ | 3-position | 4-position | 5-position | 6-position |
|---|---|---|---|---|---|---|---|
| Y-9 | (t)$C_4H_9$— | —$CH_3$ | 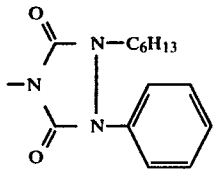 | —H | —H | 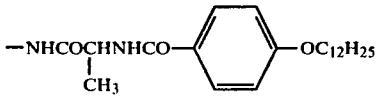 | —H |
| Y-10 | (t)$C_4H_9$— | —$CH_3$ | 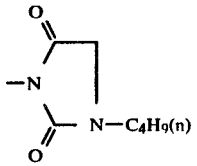 | —H | —H | —NHCOCH($CH_3$)$CH_2SO_2C_{12}H_{25}$ | —H |
| Y-11 | (t)$C_4H_9$— | —$CH_3$ | 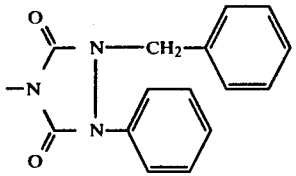 | —H | —H | —$CONH(CH_2)_2NHSO_2C_{12}H_{25}$ | —H |
| Y-12 | (t)$C_4H_9$— | —$CH_3$ | 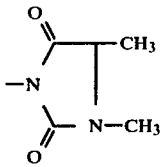 | —H | —H | —NHCOCH($CH_3$)$CH_2SO_2C_{12}H_{25}$ | —H |

-continued
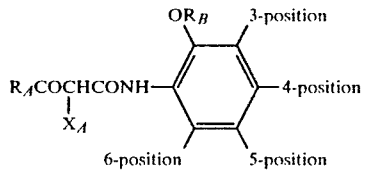
| No. | $R_A$ | $R_B$ | $X_A$ | 3-position | 4-position | 5-position | 6-position |
|---|---|---|---|---|---|---|---|
| Y-13 | (t)$C_4H_9$— | —$CH_3$ | 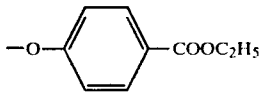 | —H | —H | 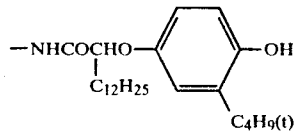 | —H |
| Y-14 | (t)$C_4H_9$— | —$C_{12}H_{25}$ | 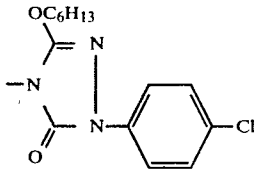 | —H | —H | —NHCO($CH_2$)$_2$SO$_2$NHCH$_2$CH($C_2H_5$)$C_4H_9$ | —H |
| Y-15 | (t)$C_4H_9$— | —$C_2H_5$ | 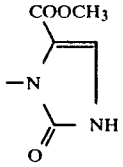 | —H | —H | 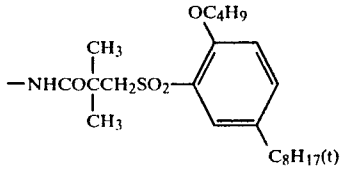 | —H |
| Y-16 | (t)$C_4H_9$— | —$CH_3$ | 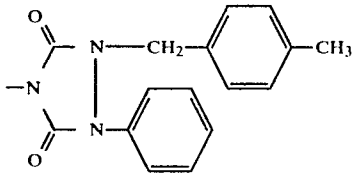 | —H | —H | —COO$C_{12}H_{25}$ | —H |
| Y-17 | 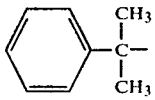 | —$C_{12}H_{25}$ | 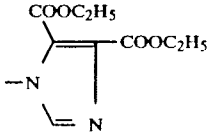 | —H | —H | —NHCO($CH_2$)$_3$NHCONHCH$_2$CH($C_2H_5$)$C_4H_9$ | —H |

-continued
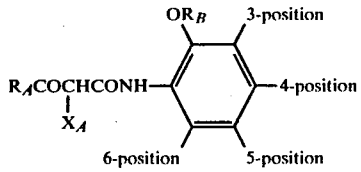
| No. | $R_A$ | $R_B$ | $X_A$ | 3-position | 4-position | 5-position | 6-position |
|---|---|---|---|---|---|---|---|
| Y-18 | (t)$C_5H_{11}$— | —$CH_3$ | 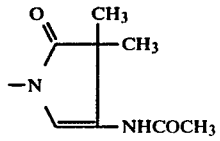 | —H | —H | —CONHCH($C_6H_{13}$)$CH_2$CONH— 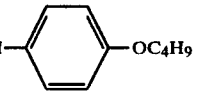 —$OC_4H_9$ | —H |
| Y-19 | (t)$C_4H_9$— | —$CH_3$ | 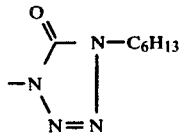 | —H | —H | —$NHCO(CH_2)_3NHCOCH_2CH(C_8H_{17})C_6H_{13}$ | —H |
| Y-20 | (t)$C_4H_9$— | —$CH_3$ | 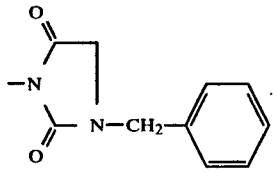 | —H | —H | —$NHCOC_{13}H_{27}$(n) | —H |
| Y-21 | (t)$C_4H_9$— | —$CH_3$ | 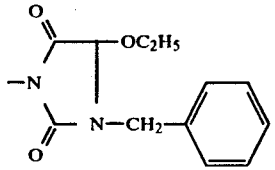 | —H | —H | —$CONHC_{14}H_{29}$(n) | —H |
| Y-22 | (t)$C_4H_9$— | —$CH_3$ | 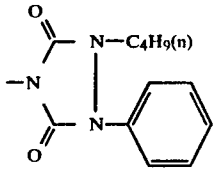 | —H | —H | —$NHCOC_{13}H_{27}$(n) | —H |

-continued
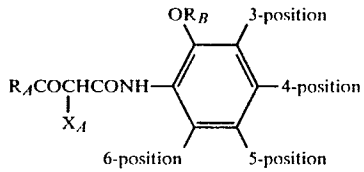
| No. | $R_A$ | $R_B$ | $X_A$ | 3-position | 4-position | 5-position | 6-position |
|---|---|---|---|---|---|---|---|
| Y-23 | (t)$C_4H_9$— | —$CH_3$ | 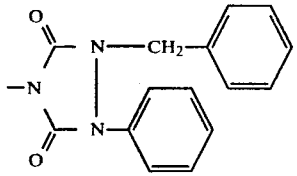 | —H | —H | —$NHCOC_{16}H_{31}$(n) | —H |
| Y-24 | (t)$C_4H_9$— | —$CH_3$ | 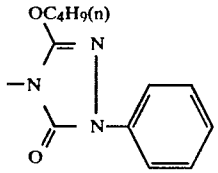 | —H | —H | —$NHCOC_{13}H_{27}$(n) | —H |
| Y-25 | (t)$C_4H_9$— | —$C_3H_7$(iso) | 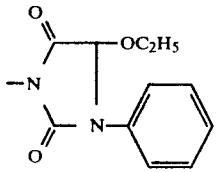 | —H | —H | —$CONHC_{14}H_{29}$(n) | —H |
| Y-26 | (t)$C_4H_9$— | —$CH_3$ | 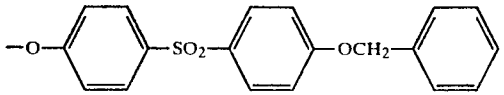 | —H | —H | —$CONHC_{14}H_{29}$(n) | —H |

-continued
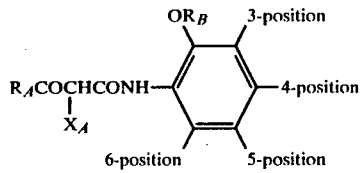
| No. | $R_A$ | $R_B$ | $X_A$ | 3-position | 4-position | 5-position | 6-position |
|---|---|---|---|---|---|---|---|
| Y-27 | (t)$C_4H_9$— | —$C_{18}H_{37}$(n) | 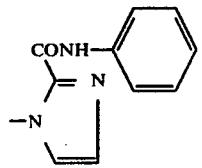 | —H | —H | —NHCOCH(CH$_3$)CH$_3$ | —H |
| Y-28 | (t)$C_4H_9$— | —$CH_3$ | 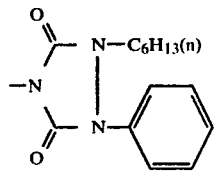 | —H | —H | —NHCO$C_9H_{19}$(n) | —H |
| Y-29 | (t)$C_4H_9$— | —$C_4H_9$ | 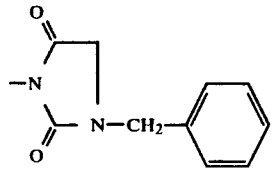 | —H | —H | —NHCO$C_{13}H_{27}$(n) | —H |
| Y-30 | (t)$C_4H_9$— | —$CH_3$ | 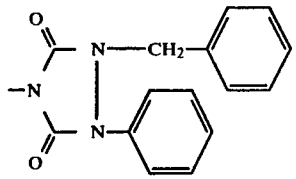 | —H | —H | —CONH$C_{14}H_{29}$(n) | —H |

-continued
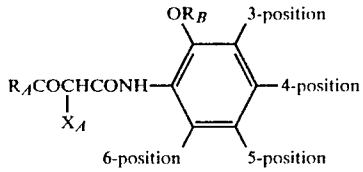
| No. | $R_A$ | $R_B$ | $X_A$ | 3-position | 4-position | 5-position | 6-position |
|---|---|---|---|---|---|---|---|
| Y-31 | (t)$C_4H_9$— | —$C_{12}H_{25}$(n) | 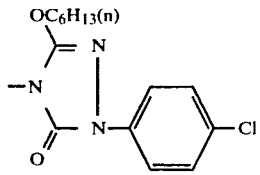 | —H | —H | —NHCOC$_{13}$H$_{27}$(n) | —H |
| Y-32 | (t)$C_4H_9$— | —$C_2H_5$ | 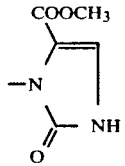 | —H | —H | —NHCOC$_{19}$H$_{30}$(n) | —H |
| Y-33 | (t)$C_4H_9$— | —$CH_3$ | 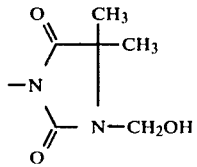 | —H | —H | —CONHC$_{16}$H$_{33}$(n) | —H |
| Y-34 | (t)$C_4H_9$— | —$CH_3$ | 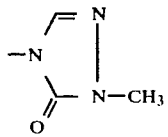 | —H | —H | —CONHC$_{14}$H$_{29}$(n) | —H |
| Y-35 | (t)$C_4H_9$— | —$CH_3$ | 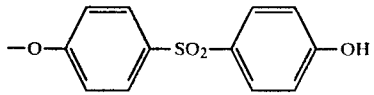 | —H | —Cl | —NHCOC$_{15}$H$_{31}$(i) | —H |

-continued
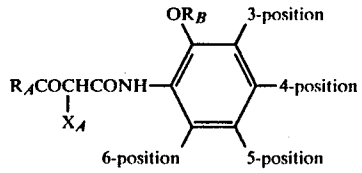
| No. | $R_A$ | $R_B$ | $X_A$ | 3-position | 4-position | 5-position | 6-position |
|---|---|---|---|---|---|---|---|
| Y-36 | (t)$C_4H_9$— | —$CH_3$ | 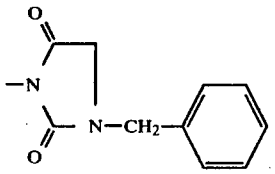 | —H | —H | —NHCOC$_{15}$H$_{31}$(n) | —H |
| Y-37 | (t)$C_4H_9$— | —$CH_3$ | 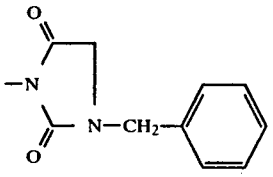 | —H | —H | —NHCOC$_{17}$H$_{36}$(n) | —H |
| Y-38 | (t)$C_4H_9$— | —$CH_3$ | 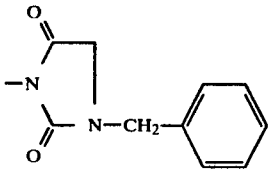 | —H | —H | —NHCOCH(CH$_3$)C$_{11}$H$_{28}$(n) | —H |
| Y-39 | (t)$C_4H_9$— | —$CH_3$ | 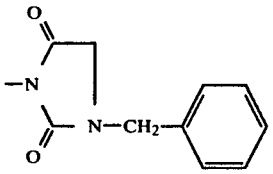 | —H | —H | —NHCOCH$_2$CH(C$_6$H$_{13}$(n))(C$_8$H$_{17}$(n)) | —H |

-continued
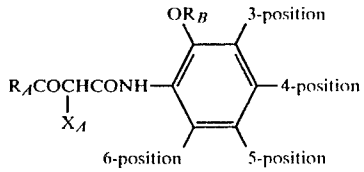
| No. | $R_A$ | $R_B$ | $X_A$ | 3-position | 4-position | 5-position | 6-position |
|---|---|---|---|---|---|---|---|
| Y-40 | (t)$C_4H_9$— | —$CH_3$ | 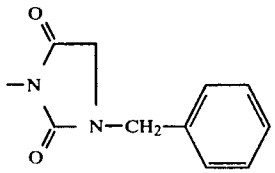 | —H | —H | —NHCO(CH$_3$)$_2$CC$_9$H$_{18}$(n) | —H |
| Y-41 | (t)$C_4H_9$— | —$CH_3$ | 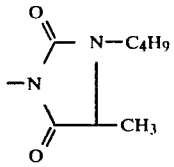 | —H | —H | —NHCOC$_{15}$H$_{31}$(i) | —H |
| Y-42 | (t)$C_4H_9$— | —$CH_3$ | 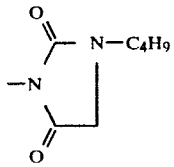 | —H | —H | —NHCOC$_{15}$H$_{31}$(i) | —H |
| Y-43 | (t)$C_4H_9$— | —$CH_3$ | 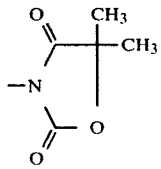 | —H | —H | —NHCOCH(CH$_3$)CHCH$_2$C(CH$_3$)$_3$)CH$_2$CH$_2$CH(CH$_3$)CH$_2$C(CH$_3$)$_3$ | —H |

-continued
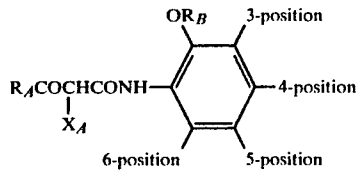
| No. | $R_A$ | $R_B$ | $X_A$ | 3-position | 4-position | 5-position | 6-position |
|---|---|---|---|---|---|---|---|
| Y-44 | (t)$C_4H_9$— | —$CH_3$ | 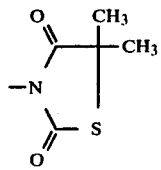 | —H | —H | —$NHSO_2C_{12}H_{25}$ | —H |
| Y-45 | (t)$C_4H_9$— | —$CH_3$ | 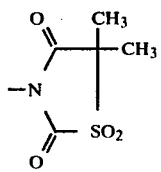 | —H | —Cl | —$COC_9H_{19}$ ‖ O | —H |
| Y-46 | (t)$C_4H_9$— | —$CH_3$ | 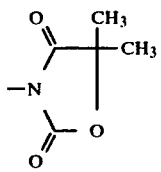 | —H | —H | —$COC_{14}H_{29}$ ‖ O | —H |
| Y-47 | (t)$C_4H_9$— | —$CH_3$ | 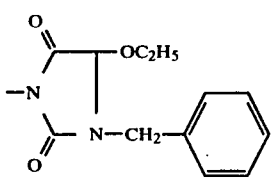 | —H | —H | —$COC_{12}H_{25}$ ‖ O | —H |

-continued
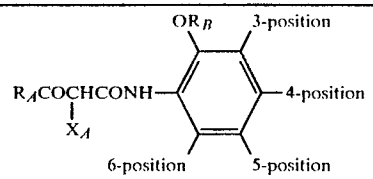
| No. | $R_A$ | $R_B$ | $X_A$ | 3-position | 4-position | 5-position | 6-position |
|---|---|---|---|---|---|---|---|
| Y-48 | (t)$C_4H_9$— | —$CH_3$ | 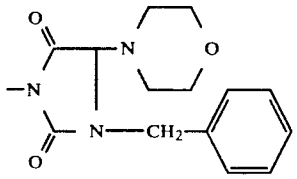 | —H | —H | —$COC_{14}H_{29}$ ‖ O | —H |
| Y-49 | (t)$C_4H_9$— | —$CH_3$ | 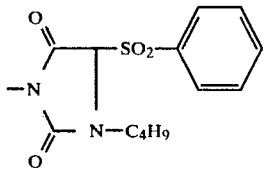 | —H | —H | 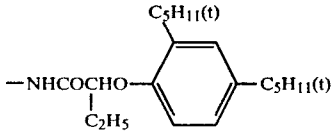 | —H |
| Y-50 | (t)$C_4H_9$— | —$CH_3$ | 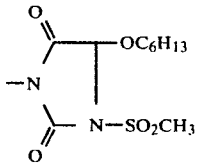 | —H | —H | —$NHCOCHCH_2SO_2C_{12}H_{26}$ \| $CH_3$ | —H |

Yellow couplers represented by formula Y-I can be prepared readily by the method described in Japanese Patent O.P.I. Publication Nos. 123047/1988, 245949/1990 and 96774/1990.

Yellow couplers represented by formula Y-I can be employed either singly or in combination. Other types of yellow coupler may also be employed together with these couplers.

A yellow coupler represented by formula Y-I is employed in an amount of about $1\times10^{-3}$ mol to about 1 mol, preferably $1\times10^{-2}$ mol to $8\times10^{-1}$ mol, per mol silver halide.

An explanation will be made on compounds represented by formula I.

The alkyl group, the cycloalkyl group and the alkenyl group represented by $R_A$, $R_B$, $R_C$ or $R_D$ may be either substituted or unsubstituted. The alkyl group and the alkenyl group may be either straight chain or branched. A straight chain alkyl group with 32 or less carbon atoms is preferable as $R_A$ or $R_B$, and a branched alkyl group with 32 or less carbon atoms is preferable as $R_C$ or $R_D$.

Specific examples of compounds hereinafter referred to as represented by formula I will be given below:

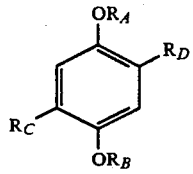

| No. | $R_A$ | $R_B$ | $R_C$ | $R_D$ |
|---|---|---|---|---|
| I-1 | $-C_5H_{11}(n)$ | $-C_5H_{11}(n)$ | $-C_4H_9(t)$ | $-C_4H_9(t)$ |
| I-2 | $-C_4H_9(n)$ | $-C_4H_9(n)$ | $-C_4H_9(t)$ | $-C_4H_9(t)$ |
| I-3 | $-C_2H_5$ | $-C_2H_5$ | $-C_4H_9(t)$ | $-C_4H_9(t)$ |
| I-4 | $-C_6H_{13}(n)$ | $-C_6H_{13}(n)$ | $-C_4H_9(t)$ | $-C_4H_9(t)$ |
| I-5 | $-CH(C_2H_5)(C_3H_7)$ | $-CH(C_2H_5)(C_3H_7)$ | $-C_4H_9(t)$ | $-C_4H_9(t)$ |
| I-6 | $-C_8H_{17}(n)$ | $-C_8H_{17}(n)$ | $-C_4H_9(t)$ | $-C_4H_9(t)$ |
| I-7 | $-CH(C_2H_5)(C_6H_{13})$ | $-CH(C_2H_5)(C_6H_{13})$ | $-C_4H_9(t)$ | $-C_4H_9(t)$ |
| I-8 | $-CH_2CH{=}CHC_2H_5$ | $-CH_2CH{=}CHC_2H_5$ | $-C_4H_9(t)$ | $-C_4H_9(t)$ |
| I-9 | $-C_{12}H_{25}(n)$ | $-C_{12}H_{25}(n)$ | $-C_4H_9(t)$ | $-C_4H_9(t)$ |
| I-10 | $-CH_2CH_2-C_6H_5$ | $-CH_2CH_2-C_6H_5$ | $-C_4H_9(t)$ | $-C_4H_9(t)$ |
| I-11 | $-CH(C_2H_5)(C_2H_5)$ | $-CH(C_2H_5)(C_2H_5)$ | $-C_5H_{11}(t)$ | $-C_5H_{11}(t)$ |
| I-12 | $-C_5H_{11}(t)$ | $-C_5H_{11}(t)$ | $-C_5H_{11}(t)$ | $-C_5H_{11}(t)$ |
| I-13 | $-C_8H_{17}(n)$ | $-C_8H_{17}(n)$ | $-C_5H_{11}(t)$ | $-C_5H_{11}(t)$ |
| I-14 | $-C_4H_9(n)$ | $-C_4H_9(n)$ | $-C_5H_{11}(t)$ | $-C_5H_{11}(t)$ |
| I-15 | $-CH(C_2H_5)(C_3H_7)$ | $-CH(C_2H_5)(C_3H_7)$ | $-C_5H_{11}(t)$ | $-C_5H_{11}(t)$ |
| I-16 | $-C_7H_{15}(n)$ | $-C_7H_{15}(n)$ | $-C_5H_{11}(t)$ | $-C_5H_{11}(t)$ |
| I-17 | $-CH(CH_3)(C_5H_{11})$ | $-CH(CH_3)(C_5H_{11})$ | $-C_5H_{11}(t)$ | $-C_5H_{11}(t)$ |
| I-18 | $-CH_2CH{=}CHC_2H_5$ | $-CH_2CH{=}CHC_2H_5$ | $-C_5H_{11}(t)$ | $-C_5H_{11}(t)$ |
| I-19 | $-C_6H_{13}(n)$ | $-C_6H_{13}(n)$ | $-C_4H_9(s)$ | $-C_4H_9(s)$ |
| I-20 | $-C_5H_{11}(n)$ | $-C_5H_{11}(n)$ | $-C_4H_9(n)$ | $-C_4H_9(n)$ |
| I-21 | $-C_6H_{13}(n)$ | $-C_5H_{11}(n)$ | $-C_5H_{11}(t)$ | $-C_4H_9(t)$ |
| I-22 | $-C_3H_7(i)$ | $-C_3H_7(i)$ | $-C_3H_7(i)$ | $-C_3H_7(i)$ |
| I-23 | $-C_8H_{17}(n)$ | $-C_8H_{17}(n)$ | $-C_8H_{17}(n)$ | $-C_8H_{17}(n)$ |

-continued

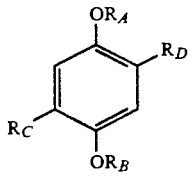

| No. | $R_A$ | $R_B$ | $R_C$ | $R_D$ |
|---|---|---|---|---|
| I-24 | 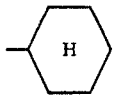 | 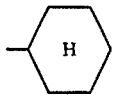 | $-C_4H_9(t)$ | $-C_4H_9(t)$ |
| I-25 | $-C_{18}H_{37}(n)$ | $-C_{18}H_{37}(n)$ | $-C_4H_9(t)$ | $-C_4H_9(t)$ |
| I-26 | $-C_{12}H_{25}(n)$ | $-C_2H_5(n)$ | $-C_4H_9(t)$ | $-C_8H_{17}(t)$ |
| I-27 | $-C_2H_5$ | $-C_2H_5$ | $-H$ | $-C_8H_{17}(t)$ |
| I-28 | $-C_8H_{17}(n)$ | $-C_8H_{17}(n)$ | $-H$ | $-C_8H_{17}(t)$ |

These compounds can be prepared readily by the method described in Japanese Patent O.P.I. Publication Nos. 8538/1979, 69141/1980 and 265251/1988.

These compounds may be employed either alone or in combination, and are employed in an amount of preferably 5 to 300 mol %, still preferably 10 to 200 mol %, based on the amount of a yellow coupler represented by formula I.

To attain the object of the invention more successfully, it is preferable to add a compound represented by formula II.

Formula II

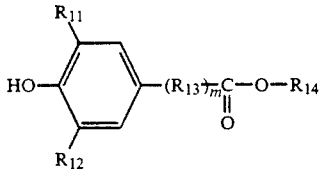

wherein $R_{11}$ and $R_{12}$ each represent an alkyl group; $R_{13}$ represents a divalent bonding group; $R_{14}$ represents a hydrogen atom or a substituent; and m represents 0 or 1.

As the alkyl group represented by $R_{11}$ or $R_{12}$, preferable is a straight chain or branched alkyl group with 1 to 24 carbon atoms. Examples include methyl, ethyl, i-propyl, t-butyl, octyl, 2-ethylhexyl, dodecyl, hexadecyl and benzyl. A branched alkyl group is preferable as $R_{11}$ or $R_{12}$.

The divalent bonding group represented by $R_{13}$ may be an alkylene group and arylene group, each of which may have a substituent.

The substituent represented by $R_{14}$ may be an alkyl group, a cycloalkyl group, an alkenyl group, an aryl group, an alkylamino group, an alkylthio group, an arylthio group, an alkoxycarbonyl group, an aryloxycarbonyl group or a heterocyclic group.

Specific examples of the compound represented by formula II will be given below:

II-1

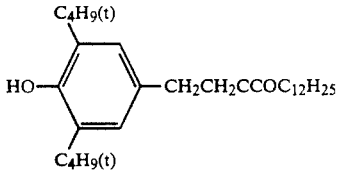

II-2

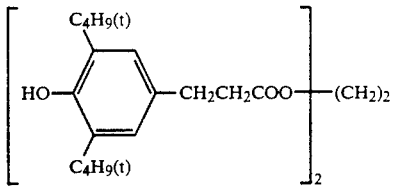

II-3

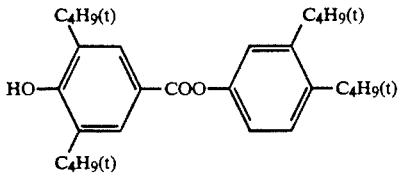

II-4

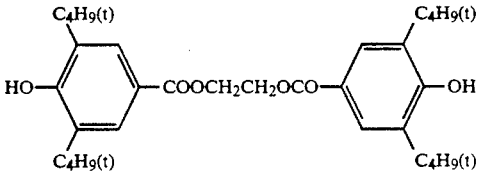

II-5

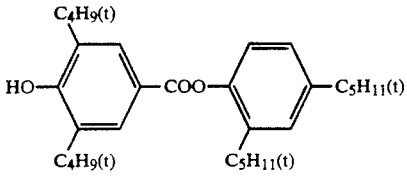

II-6

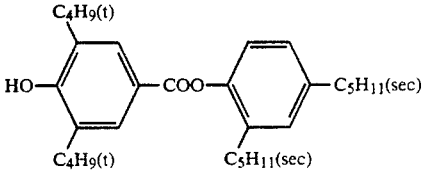

-continued
II-7
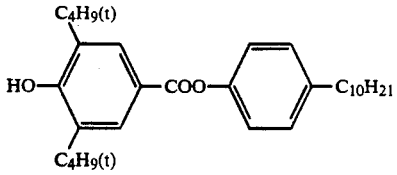
II-8
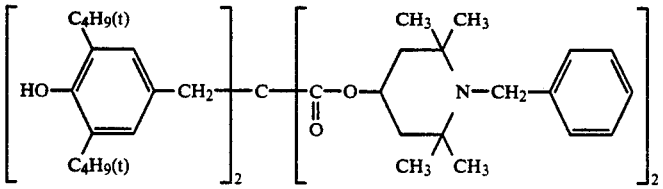
II-9
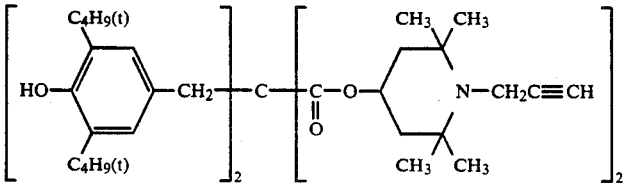
II-10
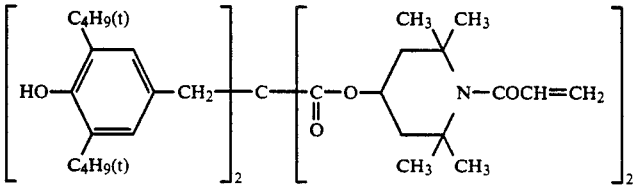
II-11
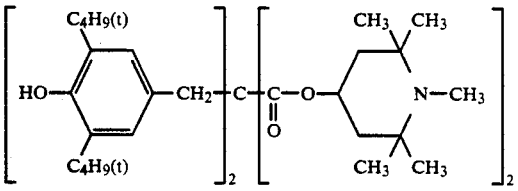
II-12
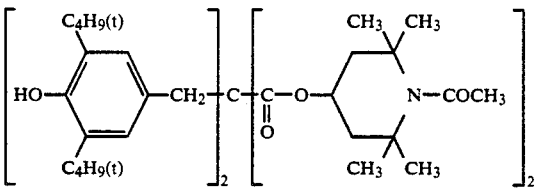
II-13
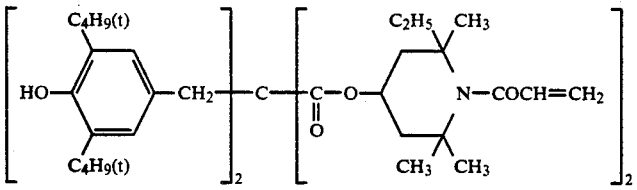
II-14
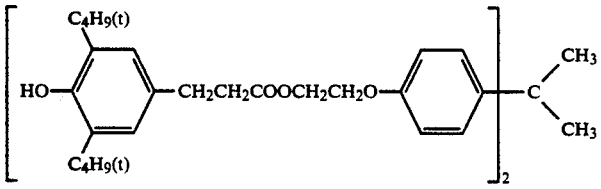
II-15
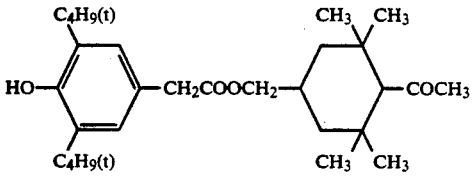
II-16
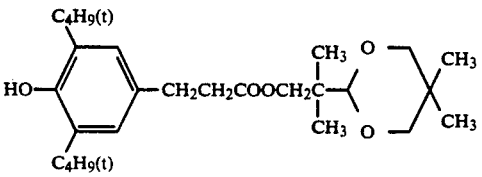

-continued

II-17

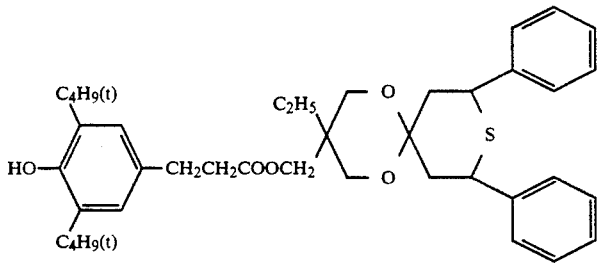

II-18

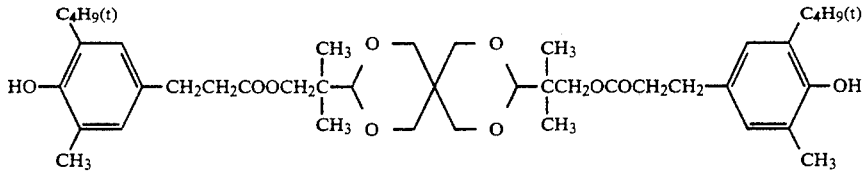

II-19

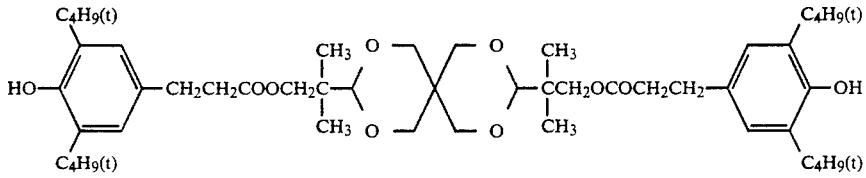

II-20

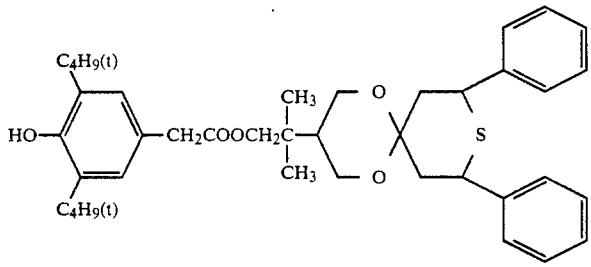

A compound represented by formula II is employed preferably in an amount of 5 to 300 mol %, still preferably 10 to 200 mol %, based on the amount of a yellow coupler represented by formula I.

A yellow coupler represented by formula Y-I, a compound represented by formula I, and a compound represented by formula II are contained in a silver halide photographic light-sensitive material by various methods including the solid dispersion method, the latex dispersion method and the oil-in-water dispersion method.

An explanation will be made on the oil-in-water dispersion method: A hydrophobic additive such as a coupler is dissolved in a high-boiling organic solvent (e.g. tricresyl phosphate, dibutyl phthalate) with a boiling point of 150° C. or higher, together with, if needed, a low-boiling solvent and/or a water-soluble organic solvent such as ethyl acetate and butyl propionate. The solution is then dispersed in a hydrophilic binder such as an aqueous gelatin solution in the presence of a surfactant. The so-formed dispersion is added to a hydrophilic colloidal layer.

The silver halide photographic light-sensitive material of the invention can be employed as a color negative film, a color positive film and color printing paper. The effects of the invention can be manifested most successfully when the invention is applied to color paper for direct appreciation.

Nowadays, color reproduction is conducted mainly by the subtractive process. In the subtractive process, use is made of a light-sensitive material in which a blue-sensitive layer that contains a yellow coupler, a green-sensitive layer that contains a magenta coupler and a red-sensitive layer that contains a cyan coupler are provided on a support. In the present invention, the number of each color sensitive layer and the order of layers are not limitative; they can be determined taking the photographic performance and the purpose of use into consideration.

As a yellow coupler that may be used in combination with a yellow coupler represented by formula Y-I, use can be made of benzoylacetoanilide-based compounds and pivaloylacetoanilide-based compounds.

Usable cyan couplers include phenol-based compounds and naphthol-based compounds.

As a magenta coupler, use can be made of pyrazoloazole-based compounds such as pyrazolopyrazole-based compounds, pyrazoloimidazole-based compounds, pyrazolotriazoles, pyrazolotetrezoles, pyrazolone-based compounds, pyrazolobenzimidazole-based compounds and open chain acylacetonitrile-based compounds.

For silver halide emulsions to be used in the present invention, use can be made of conventional silver halides such as silver bromide, silver iodobromide, silver iodochloride, silver chlorobromide and silver chloride.

Silver halide emulsions can be chemically sensitized with such sensitizers as sulfur, selenium and nobel metals, or reducing sensitizers.

Silver halide emulsions can be spectrally sensitized to a desired wavelength region by using a conventional sensitizing dye.

The silver halide photographic light-sensitive material of the invention may contain such additives as an anti-color fogging agent, a hardener, a plasticizer, a polymer latex, a UV absorber, a formalin scavenger, a mordant, a development accelerator, a development retarder, a fluorescent brightener, a matting agent, a lubricant, an anti-static agent and a surfactant.

EXAMPLES

Example 1

On a polyethylene-laminated paper support (titanium oxide content: 2.7 g/m$^2$), the following layers were provided in sequence from the support, whereby a silver halide color photographic light-sensitive material was obtained (Sample No. 1).

Layer 1: A layer containing 1.2 g/m$^2$ of gelatin, 0.32 g/m$^2$ (in terms of the amount of silver) of a blue-sensitive silver chlorobromide emulsion (silver chloride content: 99.3 mol %) and 0.75 g/m$^2$ of a yellow coupler (Y-A). The coupler had been dissolved in 0.3 g/m$^2$ of dioctyl phthalate.

Layer 2: An intermediate layer containing 0.7 g/m$^2$ of gelatin, 30 mg/m$^2$ of an anti-irradiation dye (AI-1) and 20 mg/m$^2$ of another anti-irradiation dye (AI-2)

Layer 3: A layer containing 1.25 g/m$^2$ of gelatin, 0.20 g/m$^2$ (in terms of the amount of silver) of a green-sensitive silver chlorobromide emulsion (silver chloride content: 99.5 mol %) and 0.26 g/m$^2$ of a magenta coupler (M-1). The coupler had been dissolved in 0.3 g/m$^2$ of dioctyl phthalate.

Layer 4: An intermediate layer containing 1.2 g/m$^2$ of gelatin

Layer 5: A layer containing 1.4 g/m$^2$ of gelatin, 0.20 g/m$^2$ (in terms of the amount of silver) of a red-sensitive silver chlorobromide emulsion (silver chloride content: 99.7 mol %) and 0.40 g/m$^2$ of a cyan coupler (C-1). The coupler had been dissolved in 0.2 g/m$^2$ of dibutyl phthalate.

Layer 6: A layer containing 1.0 g/m$^2$ of gelatin and 0.3 g/m$^2$ of a UV absorber (UV-1). The Uv absorber had been dissolved in 0.2 g/m$^2$ of dioctyl phthalate.

Layer 7: A layer containing 0.5 g/m$^2$ of gelatin

As a hardener, 0.017 g , per gram gelatin, of sodium 2,4-dichloro-6-hydroxy-s-triazine was added to layers 2 and 4.

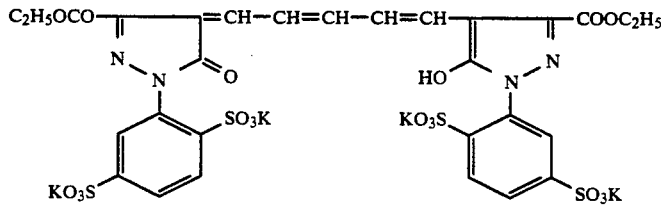
(AI-1)

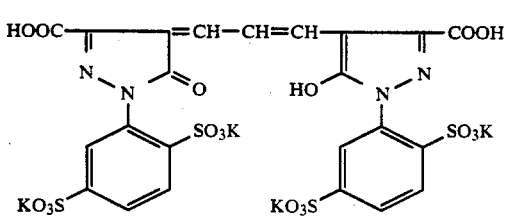
(AI-2)

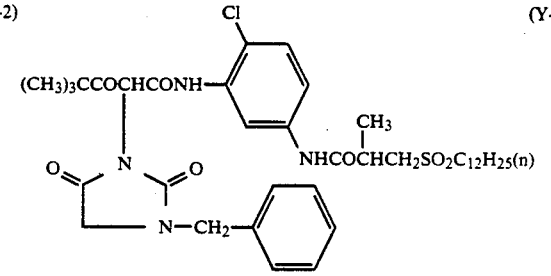
(Y-A)

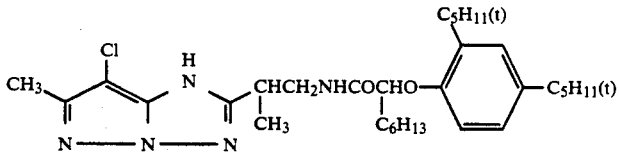
(M-1)

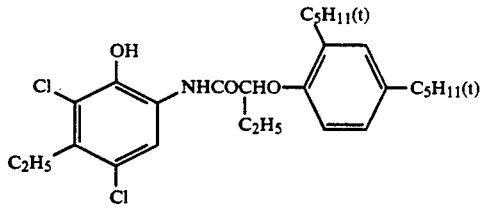
(C-1)

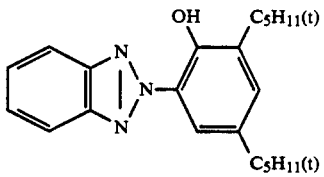
UV absorber

Sample Nos. 2 to 24 were prepared in substantially the same manner as in the preparation of Sample No. 1, except that the yellow coupler (Y-A) in layer 1 was replaced by those shown in Table 1, and a compound represented by formula I was added. Sample Nos. 25 to 30 were prepared in substantially the same manner as in the preparation of Sample Nos. 2 to 24, except that a compound represented by formula II was further added.

In each of Sample Nos. 2 to 30, the amount of the yellow coupler in layer 1 was equivalent to that of Y-A in terms of mol.

TABLE 1

| Sample No | Yellow coupler in layer 1 | Compound represented by formula I Type | Compound represented by formula I Amount, g/m² | Compound represented by formula II Type | Compound represented by formula II Amount, g/m² | Remarks |
|---|---|---|---|---|---|---|
| 1 | Y-A | — | — | — | — | Comparative example |
| 2 | Y-A | I-2 | 0.30 | — | — | Comparative example |
| 3 | Y-2 | — | — | — | — | Comparative example |
| 4 | Y-2 | I-2 | 0.30 | — | — | Present invention |
| 5 | Y-2 | I-7 | 0.30 | — | — | Present invention |
| 6 | Y-2 | I-8 | 0.30 | — | — | Present invention |
| 7 | Y-3 | I-12 | 0.30 | — | — | Present invention |
| 8 | Y-3 | I-13 | 0.30 | — | — | Present invention |
| 9 | Y-3 | I-23 | 0.30 | — | — | Present invention |
| 10 | Y-3 | I-28 | 0.30 | — | — | Present invention |
| 11 | Y-20 | I-2 | 0.30 | — | — | Present invention |
| 12 | Y-20 | I-10 | 0.30 | — | — | Present invention |
| 13 | Y-20 | I-13 | 0.30 | — | — | Present invention |
| 14 | Y-20 | I-22 | 0.30 | — | — | Present invention |
| 15 | Y-36 | I-2 | 0.30 | — | — | Present invention |
| 16 | Y-36 | I-6 | 0.30 | — | — | Present invention |
| 17 | Y-36 | I-13 | 0.30 | — | — | Present invention |
| 18 | Y-36 | I-21 | 0.30 | — | — | Present invention |
| 19 | Y-36 | I-24 | 0.30 | — | — | Present invention |
| 20 | Y-36 | I-26 | 0.30 | — | — | Present invention |
| 21 | Y-46 | I-1 | 0.30 | — | — | Present invention |
| 22 | Y-46 | I-2 | 0.30 | — | — | Present invention |
| 23 | Y-46 | I-13 | 0.30 | — | — | Present invention |
| 24 | Y-46 | I-25 | 0.30 | — | — | Present invention |
| 25 | Y-3 | I-12 | 0.20 | II-5 | 0.20 | Present invention |
| 26 | Y-3 | I-13 | 0.20 | II-10 | 0.20 | Present invention |
| 27 | Y-36 | I-2 | 0.20 | II-5 | 0.20 | Present invention |
| 28 | Y-36 | I-10 | 0.20 | II-10 | 0.20 | Present invention |
| 29 | Y-36 | I-13 | 0.20 | II-17 | 0.20 | Present invention |
| 30 | Y-36 | I-26 | 0.20 | II-18 | 0.20 | Present invention |

Each of the samples Nos. 1 to 30 was exposed to blue light through an optical wedge, and then processed according to the following procedure.

| (Processing procedure) | Temperature | Time |
|---|---|---|
| Color developing | 34.7 ± 0.3° C. | 45 sec |
| Bleach fixing | 34.7 ± 0.5° C. | 45 sec |
| Stabilizing | 30 to 34° C. | 90 sec |
| Drying | 60 to 80° C. | 60 sec |

The compositions of the processing liquids were as follows:

| | |
|---|---|
| <Color Developer> | |
| Pure water | 800 ml |
| Triethanolamine | 8 g |
| N,N-diethylhydroxylamine | 5 g |
| Potassium chloride | 2 g |
| N-ethyl-N-β-methanesulfonamidethyl-3-methyl-4-aminoaniline sulfate | 5 g |
| Sodium tetrapolyphosphate | 2 g |
| Potassium carbonate | 30 g |
| Potassium sulfite | 0.2 g |
| Pure water was added to make the total quantity 1 l, and pH was adjusted to 10.05. | |
| <Bleach Fixer> | |
| Ferric (III) ammonium ethylenediaminetetraacetate bihydrate | 60 g |
| Ethylenediaminetetraacetic acid | 3 g |
| Ammonium thiosulfate (70% solution) | 100 ml |
| Ammonium sulfite (40% solution) | 27.5 ml |
| Total amount was 1 l, and pH was adjusted to 5.7 with potassium carbonate or glacial acetic acid. | |
| <Stabilizer> | |
| 5-chloro-2-methyl-4-isothiazoline-3-one | 1 g |
| 1-hydroxyethylidene-1,1-diphosphonic acid | 2 g |
| Total amount was 1 l, and pH was adjusted to 7.0 with sulfuric acid or potassium hydroxide. | |

After the processing, the maximum density (Dmax) of the blue-sensitive emulsion layer of each sample was measured. After storage for 14 days, each sample was examined for the light fastness of the dye image by means of a fadeometer. The light fastness was expressed in terms of the ratio (%) of the density of the dye image after storage to that before storage at the area having an initial dye image density of 1.0.

Then, a color checker (manufactured by Macbeth) was photographed by means of Konica Color GX-100 (manufactured by Konica Corp.). The resulting negative was printed on each of Sample Nos. 1 to 30, after adjusting the tone of the gray portion. The samples were then processed in the same manner as mentioned above, and evaluated for color reproducibility. The results obtained are shown in Table 2.

TABLE 2

| Sample No | Maximum density | Light fastness | Color reproducibility Red | Color reproducibility Green | Color reproducibility Yellow | Remarks |
|---|---|---|---|---|---|---|
| 1 | 2.55 | 69 | B | C | C | Comparative example |
| 2 | 2.60 | 85 | B | C | C | Comparative example |
| 3 | 2.36 | 51 | A | A | A | Comparative example |
| 4 | 2.66 | 84 | A | A | A | Present invention |
| 5 | 2.57 | 80 | A | A | A | Present invention |
| 6 | 2.58 | 79 | A | A | A | Present invention |
| 7 | 2.55 | 78 | A | A | A | Present invention |
| 8 | 2.63 | 83 | A | A | A | Present invention |
| 9 | 2.54 | 79 | A | A | A | Present invention |
| 10 | 2.62 | 77 | A | A | A | Present invention |
| 11 | 2.63 | 83 | A | A | A | Present invention |
| 12 | 2.62 | 78 | A | A | A | Present invention |
| 13 | 2.62 | 83 | A | A | A | Present invention |

TABLE 2-continued

| | | | | | | |
|---|---|---|---|---|---|---|
| 14 | 2.55 | 79 | A | A | A | Present invention |
| 15 | 2.65 | 84 | A | A | A | Present invention |
| 16 | 2.64 | 83 | A | A | A | Present invention |
| 17 | 2.63 | 83 | A | A | A | Present invention |
| Sample No | Maximum density | Light fastness | Color reproducibility* Red | Green | Yellow | Remarks |
| 18 | 2.64 | 82 | A | A | A | Present invention |
| 19 | 2.54 | 79 | A | A | A | Present invention |
| 20 | 2.61 | 83 | A | A | A | Present invention |
| 21 | 2.60 | 81 | A | A | A | Present invention |
| 22 | 2.61 | 82 | A | A | A | Present invention |
| 23 | 2.61 | 81 | A | A | A | Present invention |
| 24 | 2.58 | 83 | A | A | A | Present invention |
| 25 | 2.61 | 89 | A | A | A | Present invention |
| 26 | 2.69 | 93 | A | A | A | Present invention |
| 27 | 2.65 | 91 | A | A | A | Present invention |
| 28 | 2.64 | 93 | A | A | A | Present invention |
| 2 | 2.67 | 95 | A | A | A | Present invention |
| 30 | 2.66 | 95 | A | A | A | Present invention |

Color reproducibility*
C: Poor
B: Fair
A: Excellent

As is evident from Table 2, Sample Nos. 1 and 2, each containing a yellow coupler falling outside the scope of the invention, were poor in color reproducibility though the maximum density was high.

Sample No. 3 that contained a yellow coupler of the present invention was improved in color reproducibility, but insufficient in maximum density and light fastness. Sample Nos. 4 to 24, each containing a yellow coupler represented by formula Y-I and a compound represented by formula I, had higher maximum densities and were improved both in color reproducibility and light fastness. Sample Nos. 25 to 30, each containing a yellow coupler represented by formula Y-I, a compound represented by formula I, as well as a compound represented by formula II, were extremely improved in the light fastness of a dye image.

What is claimed is:

1. A silver halide color photographic light-sensitive material comprising a support having thereon a silver halide emulsion layer containing a yellow dye-forming coupler represented by the following Formula Y-I and a compound represented by the following Formula I:

(Y-I)

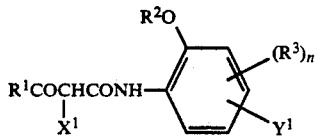

wherein $R^1$ is an alkyl group or a cycloalkyl group; $R^2$ is an alkyl group, cycloalkyl group, an acyl group or an aryl group; $R^3$ is a substituent; n is 0 or 1; $X^1$ is a substituent capable of splitting off upon coupling reaction with the oxidation product of a color developing agent; and $Y^1$ is an —NHCOR'$_4$ group, in which R'$_4$ is an organic group;

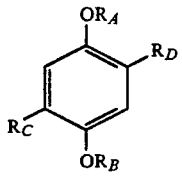

wherein $R_A$ and $R_B$ are independently an alkyl group, a cycloalkyl group or an alkenyl group; and $R_C$ and $R_D$ are independently a hydrogen atom, an alkyl group, a cycloalkyl group or an alkenyl group.

2. The light-sensitive material of claim 1, wherein the group represented by R'$_4$ is a straight chain or branched alkyl group having 1 to 30 carbon atoms.

3. The light-sensitive material of claim 1, wherein said substituent represented by Formula $X^1$ of Formula Y-I is a group represented by the following Formula IV:

(Y-IV)

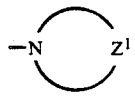

wherein $Z^1$ is a group of non-metal atoms necessary complete a five-or six-member ring together with the nitrogen atom.

4. The light-sensitive material of claim 1, wherein said yellow dye-forming coupler is contained in said emulsion layer in an amount of $1\times10^{-3}$ mole to 1 mole per mole of silver halide contained in said emulsion layer.

5. The light-sensitive material of claim 1, wherein groups represented by said $R_A$ and $R_B$ of Formula I are each a strait chain alkyl group having 32 or less carbon atoms, and groups represented by $R_C$ and $R_D$ are each a branched chain alkyl group having 32 or less carbon atoms.

6. The light-sensitive material of claim 1, wherein said compound represented by Formula I is contained in said emulsion layer in an amount of 5 to 300 mol % of said coupler contained in said emulsion layer.

7. The light-sensitive material of claim 6, wherein said compound represented by Formula I is contained in said emulsion layer in an amount of 10 to 200 mol % of said coupler contained in said emulsion layer.

8. The light-sensitive material of claim 1, wherein said emulsion layer further contains a compound represented by the following Formula II:

(II)

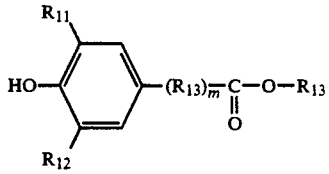

wherein $R_{11}$ and $R_{12}$ are independently an alkyl group; $R_{13}$ is a divalent linking group; $R_{14}$ is a hydrogen atom or a substituent; and m is 0 or 1.

9. The light-sensitive material of claim 8, wherein said compound represented by Formula II is contained in said emulsion layer in an amount of 5 to 300 mol % of said coupler contained in said emulsion layer.

10. The light-sensitive material of claim 9, wherein said compound represented by Formula II is contained in said emulsion layer in an amount of 10 to 200 mol % of said coupler contained in said emulsion layer.

* * * * *

UNITED STATES PATENT AND TRADEMARK OFFICE

CERTIFICATE OF CORRECTION

PATENT NO. : 5,284,742

DATED : February 08, 1994

INVENTOR(S) : Katsumasa Yamazaki et al.

It is certified that error appears in the above-indentified patent and that said Letters Patent is hereby corrected as shown below:

Claim 3, column 42, line 33, change "five-or" to --five- or--.

Claim 3, column 42, line 33, change "complete" to --to complete--.

Signed and Sealed this

Twenty-fifth Day of October, 1994

Bruce Lehman

*Attest:*

BRUCE LEHMAN

*Attesting Officer*

*Commissioner of Patents and Trademarks*